United States Patent [19]

Cate

[11] Patent Number: 4,516,518

[45] Date of Patent: May 14, 1985

[54] CATAMARAN RIGHTING ACCESSORY

[76] Inventor: John M. Cate, 434 Utah St., S.E., Albuquerque, N. Mex. 87108

[21] Appl. No.: 511,988

[22] Filed: Jul. 8, 1983

[51] Int. Cl.[3] ..... B63B 3/14

[52] U.S. Cl. ..... 114/61; 114/39

[58] Field of Search ..... 114/39, 61, 89, 123, 114/221 R

[56] References Cited

U.S. PATENT DOCUMENTS 3,865,061 2/1975 Newman ..... 114/39

FOREIGN PATENT DOCUMENTS 3004780 8/1981 Fed. Rep. of Germany ..... 114/39.2

3143317 5/1983 Fed. Rep. of Germany ..... 114/61

*Primary Examiner*—Trygve M. Blix

*Assistant Examiner*—Thomas J. Brahan

*Attorney, Agent, or Firm*—Harvey B. Jacobson; Clarence A. O'Brien

[57] ABSTRACT

An elongated structural member is provided for releasable anchoring at one end to one end of either the fore or aft transverse bracing structure extending between and anchored relative to fore and aft portions, respectively, of the hulls of a catamaran. The elongated structural member is positionable in a plane normal to the longitudinal centerlines of the hulls and inclined generally 45° relative to a plane containing the hull members with the other end of the structural member spaced outwardly from the underside of the remote hull. An elongated flexible tension member is attached at one end to the remote hull member, the mid-portion of the tension member is engaged with the other end of the structural member and the other free tension member end is free and includes handgrip means. When an associated catamaran needs to be righted, the free end of the tension member may be gripped by a person in the water and pulled downwardly upon by that person for the purpose of righting the catamaran, the structural member and tension member serving to establish a lever arm extending appreciably outwardly of the underside of the catamaran being righted and thereby enabling a downward force of less than 100 pounds on the tension member to be effective in righting a typical catamaran usually requiring the weight of a person weighing between 185 and 230 pounds utilizing a conventional righting strap or line passed over the upper hull of a catamaran to be righted.

9 Claims, 5 Drawing Figures

Fig. 1
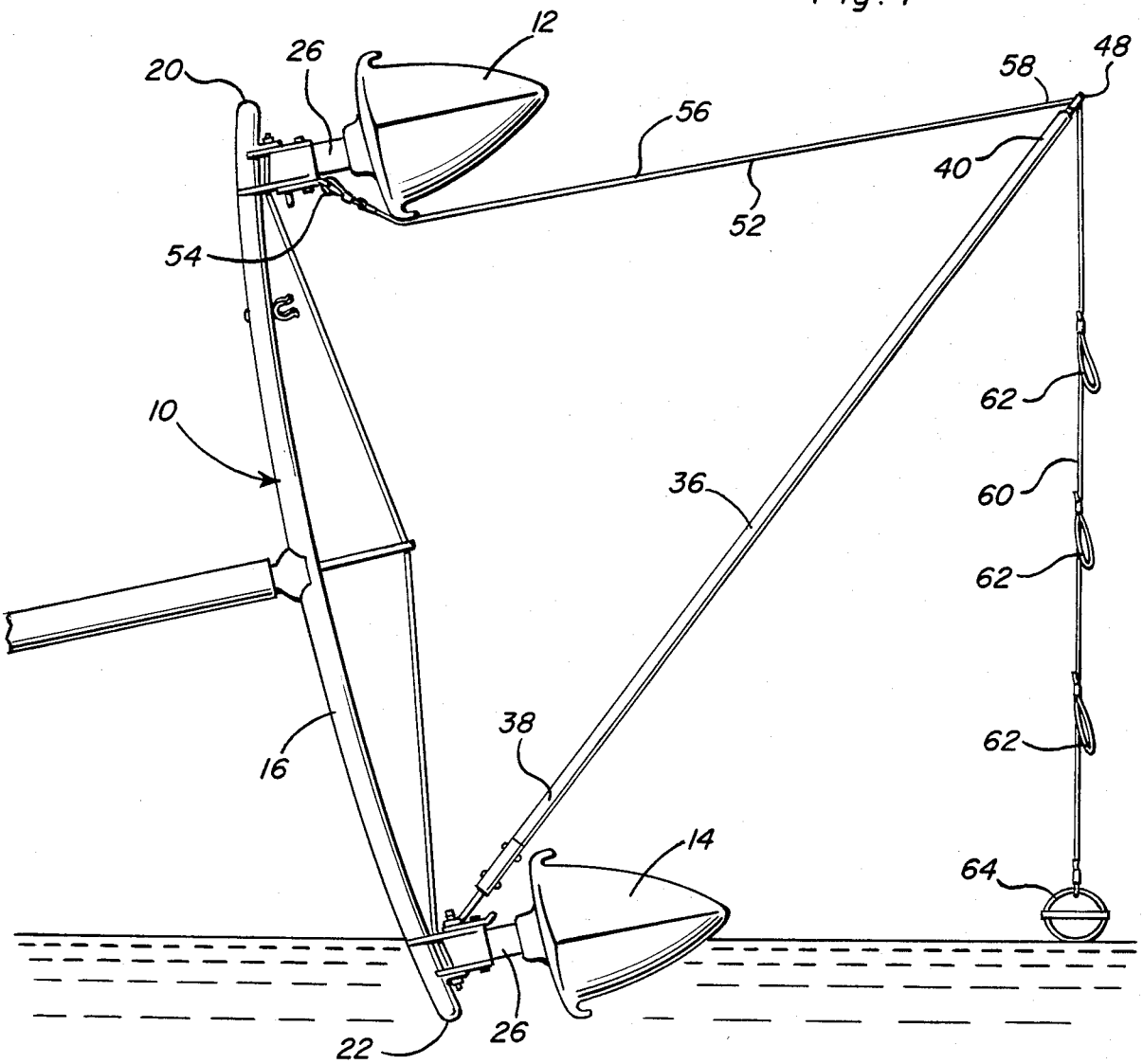
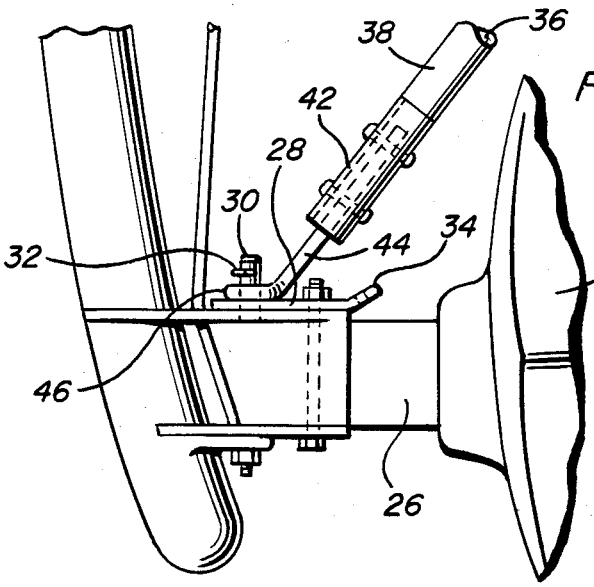
Fig. 2
Fig. 4
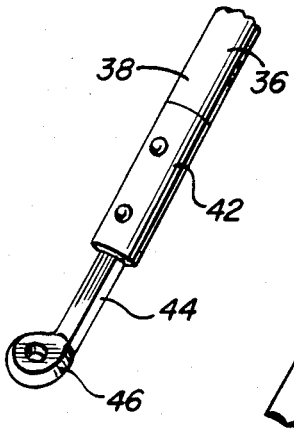
Fig. 5
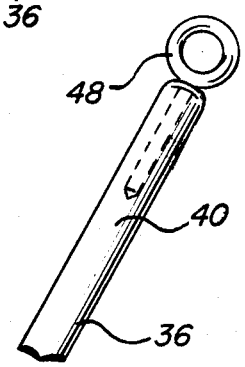

CATAMARAN RIGHTING ACCESSORY

BACKGROUND OF THE INVENTION

Probably the most popular size of catamaran is a catamaran of approximately 16 feet in length and weighing, when fully rigged, between 300 and 350 pounds. Most catamarans of this type are considered as two person racing catamarans. When such a catamaran is "blown over" an experienced two person crew will seldom have difficulty in righting the catamaran. However, such two person racing catamarans may and are often sailed by single persons and considerable difficulty can be encountered by a single person attempting to right a catamaran of the aforementioned type, inasmuch as the righting of these catamarans requires between 185 pounds and 230 pounds of crew person weight when a single crew person is using a conventional righting strap. Accordingly, a need exists for a righting accessory of lightweight construction and which may be readily adapted for use in conjunction with various different types of catamarans and used effectively as a force multiplier by a single crewman in righting a catamaran.

Various different forms of catamaran righting accessories and other boating equipment including some of the general structural and operational features of the instant invention are disclosed in U.S. Pat. Nos. 3,048,139, 3,370,560, 3,820,489 and 3,865,061.

BRIEF DESCRIPTION OF THE INVENTION

The catamaran righting accessory of the instant invention comprises an elongated lightweight structural member of pole and means for removably attaching one end of the pole to one of the hull members of a catamaran adjacent one of the two fore and aft transverse bracing members which extend between and interconnect the hulls. The pole is attached at its one end in a manner such that the free end of the pole is disposed in a plane substantially normal to the longitudinal centerlines of the hulls and spaced from the bottom of the remote hull member, the pole being inclined generally 45° relative to a plane containing the hull members. When the pole is anchored relative to the lower hull member of a capsized catamaran, the pole projects upwardly and outwardly from the underside of the catamaran to a level substantially horizontally aligned with the upper hull member and one end of an elongated flexible tension member is anchored relative to the upper hull, the mid-portion of the tension member is guidingly engaged with the free end of the pole and the other end of the tension member depends downwardly from the free end of the pole and includes longitudinally spaced handgrip portions by which a person in the water beneath the upper free end of the pole may grasp and pull downwardly upon the tension member in order to right the catamaran.

The pole is attached to the catamaran in a manner such that it may be swung to a stored position extending diagonally across the space between the hulls of the catamaran with the pole being substantially horizontally disposed when the catamaran is upright. In this manner, the pole may be readily carried beneath the trampoline of a catamaran until its use is required.

It is to be noted that a catamaran equipped with the righting accessory of the instant invention will have mounts for the pole on each of the hull members thereof in order that the righting accessory may be effectively used to right a blown-over catamaran when either hull is disposed lowermost.

The main object of this invention is to provide a righting accessory which may be used to right a catamaran.

Another object of this invention is to provide a righting accessory for a catamaran which will enable a catamaran to be righted by a single lightweight crew person.

Still another object of this invention is to provide a catamaran righting accessory which may be adapted for use on various makes of catamarans.

A final object of this invention to be specifically enumerated herein is to provide a catamaran righting accessory which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a front elevational view of a capsized catamaran with the righting accessory of the instant invention in operative association with the catamaran preparatory to righting the same;

FIG. 2 is an enlarged fragmentary elevational view of the structure illustrated in the lower portion of FIG. 1;

FIG. 4 is a fragmentary enlarged perspective view of the base end portion of the elongated structural member or pole portion of the righting accessory; and FIG. 5 is a fragmentary enlarged perspective view of the free end of the elongated structural member or pole portion of the righting accessory.

DETAILED DESCRIPTION OF THE INVENTION

Figure 3:
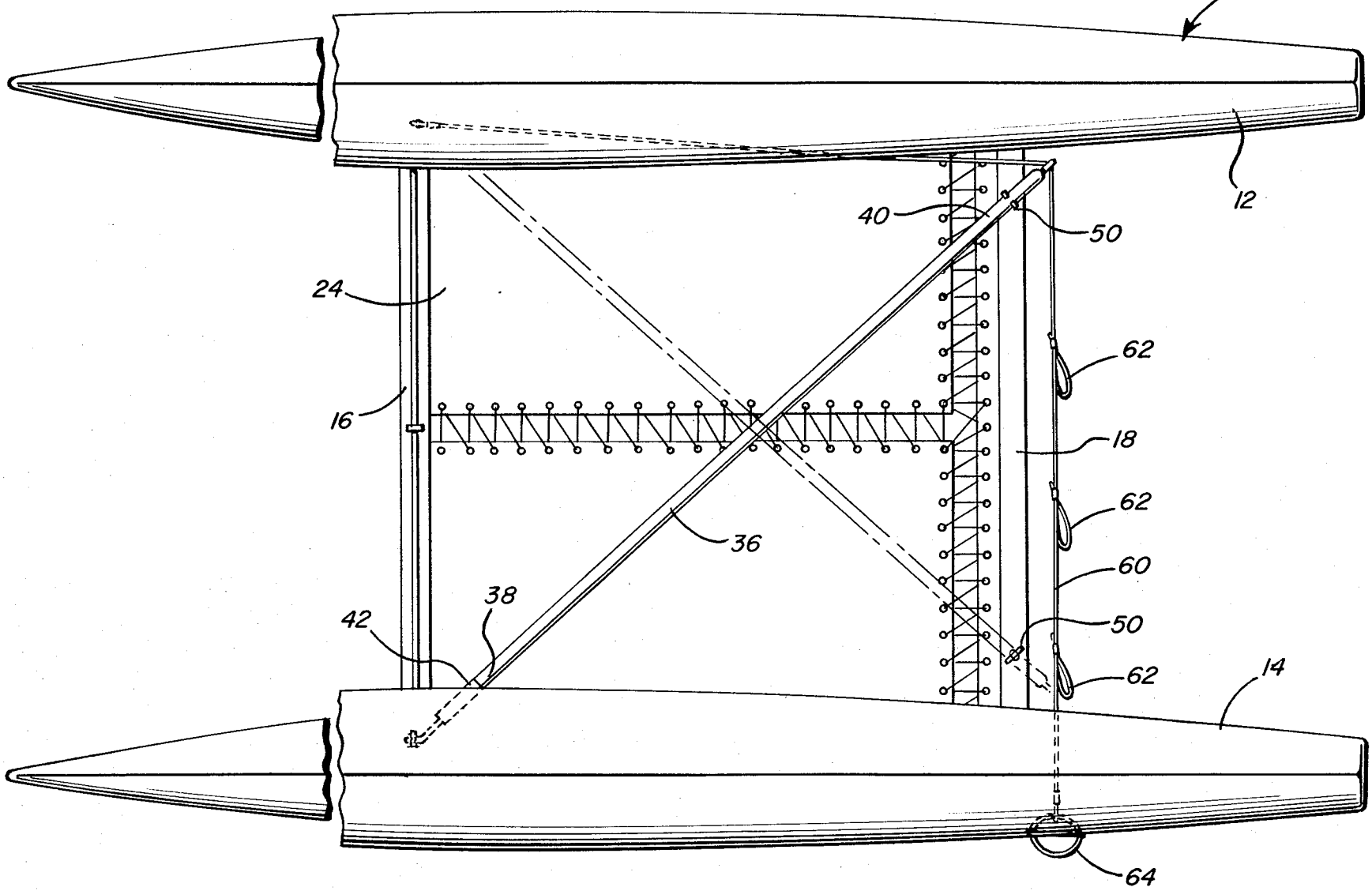
FIG. 3 is a fragmentary bottom plan view of a catamaran illustrating the manner in which the righting accessory may be carried in a stored position beneath the trampoline of the catamaran.

Referring now more specifically to the drawings the numeral 10 generally designates a conventional form of catamaran including a pair of opposite side hulls 12 and 14 interconnected by fore and aft elongated transverse bracing structures 16 and 18. The bracing structures 16 and 18 have corresponding ends thereof interconnected by longitudinally extending members 20 and 22 and the structures 16, 18 and the members 20 and 22 define a support frame from which a trampoline 24 spanning between the hulls 12 and 14 is supported, the four corner portions of the aforementioned frame being anchored relative to the hulls 12 and 14 by four corner supports 26 which support the frame in elevated position above the hull members 12 and 14.

The righting accessory of the instant invention includes a pair of mounts 28 secured to the inside upper portions of the forward corner supports 26 and each mount 28 includes a horizontally projecting pivot shank 30 provided with a free end diametric bore through which a retaining clip 32 may be releasably engaged. In addition, each mount 28 includes an apertured anchor eye portion 34. Further, the righting accessory includes an elongated structural member or pole 36 having first and second ends 38 and 40. A ferrule 42 is mounted from the first end 38 and supports an endwise outwardly projecting shank 44 having an angulated apertured eye 46 on its free end. The eye 46 is angulated approximately 45° relative to the pole 36 and the second end 40 of the pole 36 includes an eye member 48 supported therefrom. In addition, the opposite ends of the rear transverse brace structure 18 include a pair of spring clamps 50 supported from the underside thereof. The eye 46 may be engaged over either of the pivot shanks 30 and retained thereon by the corresponding clip 32. When thus mounted, the pole 36 is pivotally supported from the corresponding mount 28 for angular displacement relative thereto from a stored position extending diagonally across the space between the hulls 12 and 14 (see FIG. 3) and an operative hull righting position such as that illustrated in FIG. 1 with the pole disposed in a plane substantially normal to the longitudinal centerlines of the hulls 12 and 14 and inclined upwardly and outwardly from the lower hull member 14 when the catamaran 10 is in the capsized position thereof illustrated in FIG. 1.

When the pole 36 is in the stored position thereof illustrated in FIG. 3, the free end of the pole 36 may be releasably clamped in position by the adjacent clamp 50.

The righting accessory additionally includes an elongated flexible tension member 52 having a clip or hook 54 at the terminal end of a first end portion 56 thereof and the clip or hook 54 may be engaged with either eye portion 34 and the mid-portion 58 of the tension member 52 may be passed through the eye member 48. The other free end portion 60 of the tension member 52 may depend downwardly from the eye member 48 and is provided with longitudinally spaced handgrip members 62 as well as a terminal end combined stirrup and handgrip ring 64.

In operation, when the catamaran 10 capsizes, the structural member or pole 36 is erected in the position thereof illustrated in FIG. 1 with the tension member 52 anchored relative to the uppermost eye portion 34 and having its mid-portion 58 passed through the eye member 48. Then, a person in the water adjacent the ring 64 may grasp the latter and pull downwardly thereon and successively downwardly on the handgrips 62 in order to right the catamaran 10. When the catamaran has been righted, the support member or pole 36 may be swung to the stored position thereof illustrated in FIG. 3 and retained in the stored position by the associated clip or clamp 50. Thereafter, the free end 60 of the tension member 52 may be suitably anchored relative to the rear corner support or other suitable structure remote from the eye member 48.

Although the righting accessory has been illustrated and described in use in conjunction with a catamaran of the type including the aforementioned trampoline supporting frame mounted from the hull members 12 and 14 through the utilization of the corner supports 26, it is to be noted that different forms of mounts corresponding to the mounts 28 may be used on other types of catamarans which do not include the equivalent of the corner supports 26. It is only important that whatever mounts are provided include pivot shanks corresponding to the pivot shanks 30.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a boat having a pair of laterally spaced apart elongated longitudinally extending hulls connected together by a elongated fore and aft transverse bracing structures extending between and anchored relative to fore and aft portions, respectively, of said hulls and wherein said hulls include normally upper and lower surfaces and said boat includes a mast stepped from said fore transverse bracing structure and projecting upwardly therefrom, a righting accessory including mounting means mounted from the underside of one end of said transverse bracing structures adjacent one of said hulls, an elongated structural member, anchor means mounting one end portion of said structural member from said mounting means with said structural member disposed generally in a first plane normal to the longitudinal centerlines of said hulls and with the other end portion of said structural member disposed at least closely adjacent a second plane generally paralleling said most and extending along the longitudinal centerline of the other hull with said other end portion disposed outwardly of the underside of said boat, and elongated flexible tension member means having one end portion anchored relative to the other end of said one bracing structure, a mid-portion thereof engaged with the other end of said structural member and a second free end portion.

2. The righting accessory of claim 1 wherein said free end portion includes handgrip means anchored relative thereto.

3. The righting accessory of claim 2 wherein said handgrip means includes a plurality of handgrip portions spaced along said free end portion.

4. The righting accessory of claim 3 wherein said free end portion includes a terminal end portion relative to which foot engageable stirrup means is anchored.

5. In combination with a boat having a pair of laterally spaced apart elongated longitudinally extending hulls connected together by elongated fore and aft transverse bracing structures extending between and anchored relative to fore and aft portions, respectively, of said hulls, a righting accessory including mounting means mounted from one end to one of said transverse bracing structures adjacent one of said hulls, an elongated structural member, anchor means mounting one end portion of said structural member from said mounting means with said structural member disposed generally in a first plane normal to the longitudinal centerlines of said hulls and with the other end portion of said structural member disposed at least closely adjacent a second plane extending along the longitudinal centerline of the other hull and disposed outwardly of the underside of said boat, and elongated flexible tension member means having one end portion anchored relative to the other end of said one bracing structure, a mid-portion thereof engaged with the other end of said structural member and a second free end portion, said mounting means and said one end of said structural member including pivot means pivotally mounting said one end of said structural member from said one transverse bracing structure for angular displacement relative thereto about an axis inclined relative to said structural member and disposed generally normal to said second plane for movement of said structural member to a retracted position with said other end thereof closely adjacent the end of said other transverse brace structure adjacent said other hull and with said structural member generally paralleling a third plane containing said hulls.

6. The righting accessory of claim 5 including anchor means releasably anchoring said other end of said structural member to the last-mentioned transverse bracing structure end.

7. The righting accessory of claim 5 wherein the other end of said one transverse bracing structure also includes mounting means corresponding to the first-mentioned mounting means, said pivot means including means pivotally mounting said one end of said structural member, selectively, from one of said mounting means.

8. The righting accessory of claim 7 wherein the opposite ends of said other transverse bracing structure include anchor means for releasably anchoring said other end of said structural member to said other transverse bracing structure ends.

9. In combination with a capsized boat of the type having a pair of laterally spaced apart elongated longitudinally extending hulls connected together by bridging structure having upper and lower sides as defined when said boat is in the normal sailing attitude and extending and connected between central portions of said hulls intermediate the opposite ends thereof and wherein said boat includes a mast stepped from said bridging structure and projecting outwardly therefrom in the direction in which said upper side faces, said hulls including upper and lower surfaces facing in the directions in which said upper and lower sides face, said boat being disposed with one of said hulls lowermost and the other hulls spaced above said one hull because of the capsized condition of said boat, a righting accessory including an elongated structural member, means anchoring one end of said structural member relative to the central portion of said one hull outwardly of said lower side and with said structural member disposed in a first plane generally normal to the longitudinal centerlines of said hulls and the other end of said structural member spaced horizontally outward from said lower surface of the central portion of said other hull, an elongated flexible tension member having one end portion anchored relative to said central portion of said other hull, a mid-length portion supported from said other end of said structural member and its other end portion depending downwardly from said other end of said structural member.

* * * * *